United States Patent [19]

Calvert et al.

[11] 3,991,660

[45] Nov. 16, 1976

[54] CARTON EXPANDER

[75] Inventors: Rodney K. Calvert, Dunwoody; Charles Rabun Landrum, Doraville, both of Ga.

[73] Assignee: The Mead Corporation, Dayton, Ohio

[22] Filed: Apr. 15, 1975

[21] Appl. No.: 568,243

[52] U.S. Cl. ..... 93/53 SD
[51] Int. Cl.[2] ..... B31B 1/76
[58] Field of Search ..... 93/53 SD, 53 R, 53 M

[56] References Cited

UNITED STATES PATENTS

| | | | |
|---|---|---|---|
| 2,900,880 | 8/1959 | Engleson et al. | 93/53 SD |
| 3,220,159 | 11/1965 | Killeen | 93/53 SD UX |
| 3,298,289 | 1/1967 | Szabo | 93/53 SD |
| 3,418,893 | 12/1968 | Stohlquist et al. | 93/53 SD |
| 3,420,037 | 1/1969 | Villemure et al. | 93/53 SD X |
| 3,814,000 | 6/1974 | Heisler | 93/53 SD |

*Primary Examiner*—Frank T. Yost
*Attorney, Agent, or Firm*—Walter M. Rodgers; Walter A. Rodgers

[57] ABSTRACT

A plurality of collapsed open ended sleeve-type cartons are withdrawn in sequence from a hopper by feeder means which engages a single wall of each carton and moves in such a direction as to cause another wall of the carton to engage fixed cam means having a camming surface disposed at an angle to the general direction of feeding movement of cartons from the hopper so as partially to set up the open ended sleeve-type carton. A carton feeding operation is performed by a main feeding arm to which a supplementary feeder arm is pivotally connected and biased to impart desired pressure to the carton to facilitate setting the carton up during initial stages of a withdrawal operation. After a carton is withdrawn from the hopper, the feeder means moves into cooperative relationship with a carton stripper which insures that the feeder arm disengages the carton and immediately thereafter an oscillatable pusher advances the carton in partially set-up condition into cooperative engagement with a plurality of spaced flight bars which control the movement of the open ended carton while loading of the carton is effected from both ends simultaneously by suitable guides following which carton end closure panels are folded by machine guides into closed positions and subsequently interlocked by locking means which operates in synchronism with the flight bars to complete the package.

10 Claims, 8 Drawing Figures

CARTON EXPANDER

Known machines for loading a plurality of articles through one or both ends of a sleeve-type carton ordinarily are dimensioned and constructed in such a way that substantial spacing between cartons during and following the loading operation is necessary. Of course such spacing imposes a substantial limitation on the quantity of cartons which may be loaded in a given period of time. Sometimes machines of this type are operated at extremely high speeds in order to offset the inherent disadvantage which results from widely spacing the cartons during and following loading. Of course high speed operation imposes a much greater degree of wear and substantially enhances the possibility of down time and increases the cost of repairs and maintenance.

Sleeve-type open ended blanks which are collapsed and disposed in a hopper from which the cartons are withdrawn in sequence and which include a glue lap frequently are difficult to set up because glue from the lap effects an undesired bond with a panel of the carton which is disposed in face contacting relation thereto. Cartons of this type also tend to bow downwardly and thus impede effective withdrawal.

According to this invention, open-ended sleeve-type cartons are fed in sequence from a hopper and are manipulated by improved feeder means in such manner as to insure that any possible undesired bond due to glue used in the glue lap with a face contacting panel is ruptured and in addition the carton is manipulated during a withdrawal operation so as to be partially set up as it is stripped from the feeder mechanism. Immediately following a stripping operation a carton is moved along the loading path by synchronously oscillatable pusher means which causes the set-up carton with its ends open to move in between a pair of moving flight bars, the width of the flight bars in the direction of travel being approximately equal to the spacing between the trailing panel of a carton and the leading panel of a succeeding carton so that undesired spacing between sequentially movable cartons is eliminated.

For a better understanding of the invention reference may be had to the following detailed description taken in conjunction with the accompanying drawings in which FIG. 1 is a plan view of essential portions of a machine constructed according to this invention;

FIG. 7 is a view similar to FIGS. 4, 5 and 6 and shows the parts in the positions which they occupy at approximately the instant when an open ended set-up carton is moved in between a pair of spaced synchronously moving flight bars for loading and closing; and in which

Figure 1:
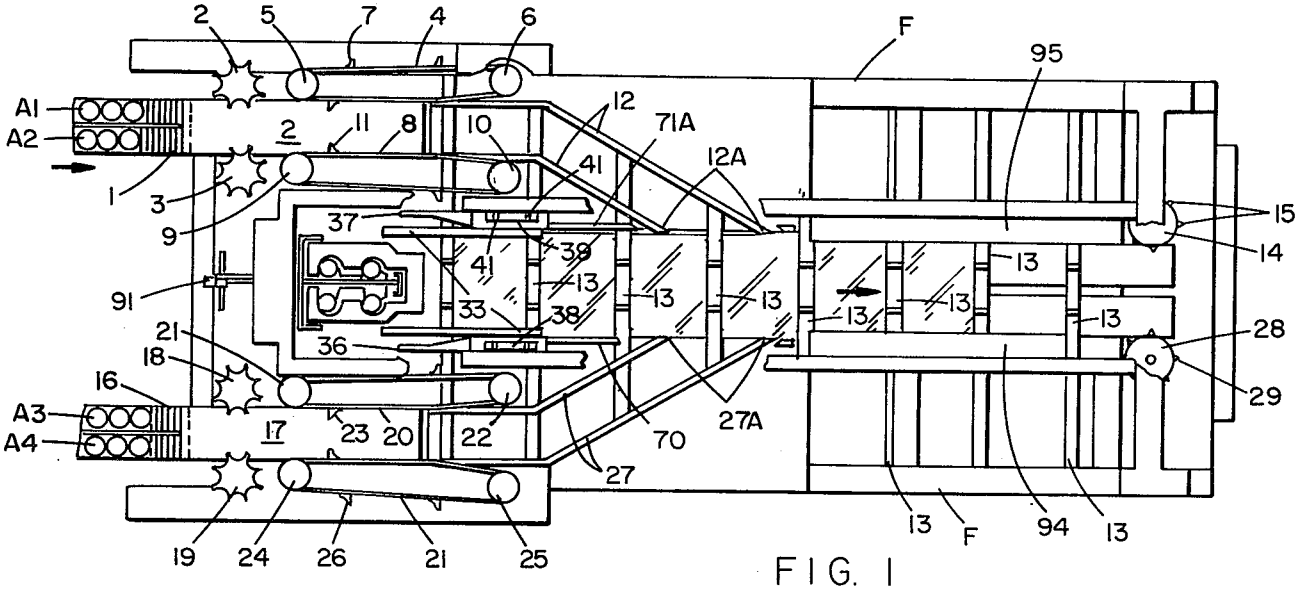
Figure 2:
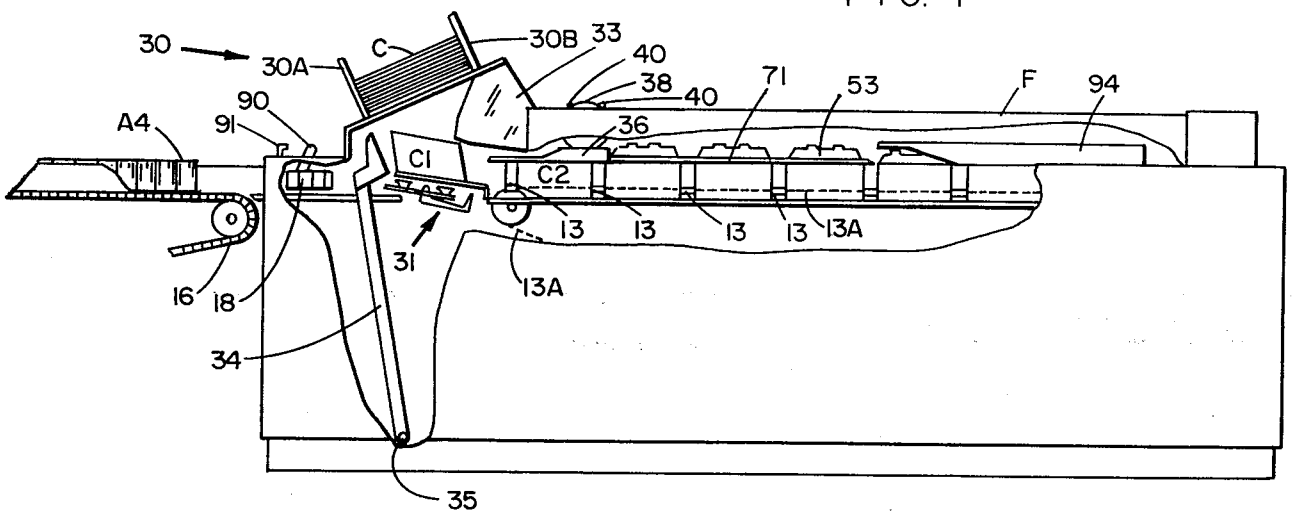
FIG. 2 is a front profile view of the structure shown in FIG. 1.

As shown in FIGS. 1 and 2, the frame of the machine is designated F and two rows of articles such as are designated at A1 and A2 are brought into the entry end of the machine on infeed conveyor 1 and are then deposited onto moving conveyor 2. The velocity of movement of articles A1 is controlled in known manner by rotatable starwheel 2 while movement of articles A2 is regulated and metered by starwheel 3. Endless element 4 which is rotatably supported on rotatable elements 5 and 6, one of which is a driven element and the other of which is an idler element, is provided with a plurality of spacer wedges 7 which move into the spaces between certain articles A1 and thus divide the articles into spaced groups. Similarly endless element 8, supported on rotatable elements 9 and 10 one of which is driven, is provided with a plurality of spacer wedges 11 which divide the articles A2 into spaced groups. After the articles are arranged in groups such as a group of six for example including three articles A1 and three articles A2 they are passed downwardly between spaced guides 12 and are thus loaded through one open end of a set-up carton disposed at the outlet ends 12A of the guides 12. During and prior to the loading and during end closure operations performed on a sleeve, a carton is under the control of a plurality of flight bars 13 which move in synchronism with the other elements of the machine in known manner. The ends of flight bars 13 are secured to spaced chains mounted on sprockets is known manner.

In order to close the ends of a carton after it is loaded, a rotatable element 14 having lock engaging radially extending probes 15 effects a locking operation on the closure panels at one end of the carton.

The other side of the machine is identical to that described and its parts will simply be mentioned briefly. For example, articles A3 and A4 are brought into the infeed end of the machine on infeed conveyor 16 and are then transferred to conveyor 17 while starwheels 18 and 19 determine the velocity of movement of the articles on conveyor 17. The articles A3 are spaced into groups by endless element 20 which is supported on the rotatable elements such as sprockets 21 and 22 and on which spacer wedges 23 are disposed to impart a grouping action. Similarly endless element 21 is movably supported by rotatable elements 24 and 25 and is provided with a series of spacer wedges 26 for grouping the articles A4 as explained. Guides 27 are arranged with their discharge ends 27A alongside and adjacent the path of movement of the open ended sleeves which are under the control of spaced flight bars 13 which move from left to right so that articles A3 and A4 are loaded into the opposite end of the open ended sleeve type cartons from that through which the articles A1 and A2 are loaded. Closure panels at the end of the carton through which articles A3 and A4 are loaded after being plowed into closed position, are closed by rotatable closure element 28 having radially disposed lock engaging probes 29. Of course all the parts operate in synchronism so that when a carton clears rotatable elements 14 and 28 it is then complete in finished condition.

Collapsed open ended cartons C are disposed in hopper 30 above the paths of movement of the articles A1, A2 on one side and the articles A3, A4 on the other side. Carton feeding means generally designated by the numeral 31 is pivotally mounted at pivot 32 and operated by suitable means not shown in FIGS. 1 and 2 in an oscillating fashion into engagement with a lowermost carton C in hopper 30 to engage that carton and to withdraw it from the hopper. The collapsed blank is withdrawn from the hopper and is opened at least partially during the withdrawal operation by downward movement of feeder means 31 which causes a part of the carton to engage the cam surface 33A of the fixed cam 33 thus to impart swinging movement to the carton panels which are foldably joined to the wall of the carton which is engaged by feeder means 31. A carton that has been withdrawn is indicated at C1.

In order to move a carton located such as that indicated as C1 into the space between a pair of spaced flight bars 13 which are driven from left to right during loading and closing operations by virtue of their mounting to a pair of endless elements 13A disposed on opposite sides of the machine, an oscillatable pusher 34, pivotally mounted at 35 and driven by suitable means from left to right about pivot 35, engages the trailing edge of carton C1. As the oscillating motion of pusher 34 to the right continues, the leading part of the carton moves into engagement with flight bar 13 which is disposed at the left hand end of the working or upper reach of endless element 13A. Continued movement of the working reach of element 13A toward the right as viewed in FIGS. 1 and 2 and continued incremental movement of pusher element 34 about its pivot 35 in a clockwise direction causes the carton C1 to occupy the position between two flight bars 13 represented at C2 in FIG. 2. During this phase of the packaging operation, closure end flaps of the carton are plowed upwardly by fixed guides 36 and 37 and a pair of rotatable pre-brake elements 38 and 39 having radially disposed probes 40 and 41 initiate swinging movement of locking tabs formed in the upper end closure panels out of the plane of their associated panels and condition those tabs for subsequent insertion into the appropriate apertures in a cooperating closure panel.

Figure 3:
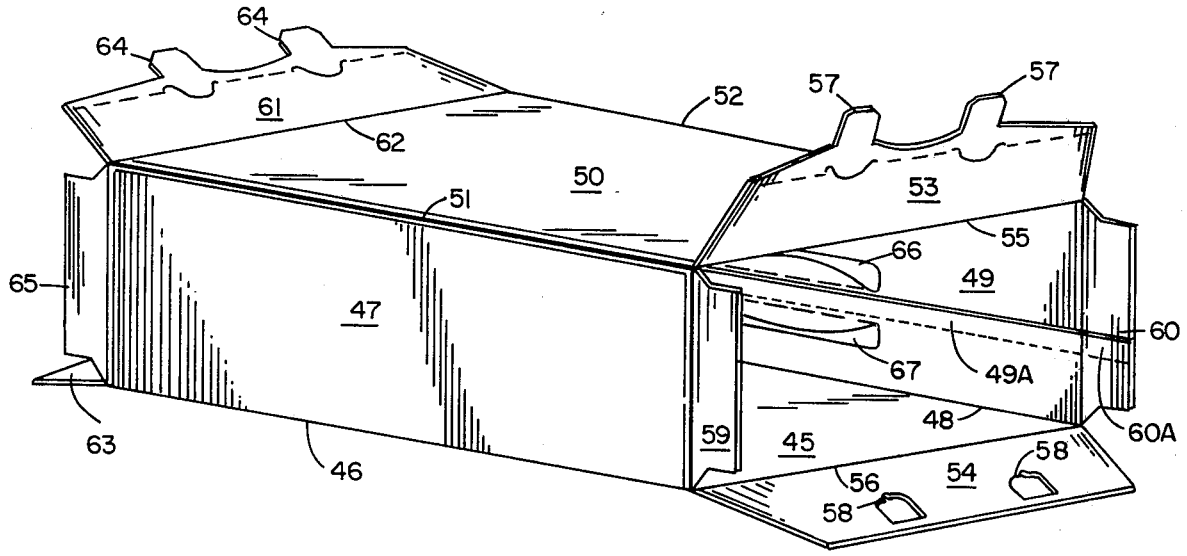
FIG. 3 is a perspective view of a set-up open ended sleeve type carton which is manipulated from a hopper, set up into the condition shown in FIG. 3 and then loaded through its open ends and closed by the machine and method of this invention.

An open ended sleeve type carton which includes a manufacturer's glue joint and which is provided with end closure panels and their associated interlocking means is shown in FIG. 3. The machine and method of this invention are specially adapted for use with the carton of FIG. 3. This carton includes a wall panel 45 foldably joined along fold line 46 to wall panel 47 and foldably joined along fold line 48 to wall panel 49. Wall panel 49 includes overlapping panels which form a glue joint at the intermediate portion of wall 49, the glue joint being designated at 49A. Wall panel 50 is foldably joined to wall panel 47 along fold line 51 and to wall panel 49 along fold line 52. End closure panels 53 and 54 are foldably joined to one end edge of panels 50 and 45 along fold lines 55 and 56. Locking tabs 57 are foldably joined to panel 53 and cooperate with locking apertures 58 formed in panel 54. Flaps 59 and 60 are foldably joined to corresponding ends of walls 47 and 49. The glue joint 60A is simply a continuation of a joint designated 49A and comprises overlapping edges of the upper and lower parts of flap 60.

At the other end of the carton, closure panel 61 is foldably joined to wall 50 along fold line 62 while closure panel 63 is foldably joined to wall 45 along a fold line not observable in FIG. 3. Locking tabs 64 are foldably joined to closure panel 61 and locking apertures such as 58 are formed in closure panel 63 but are not observable in FIG. 3. Flap 65 is foldably joined to the end wall 47 and a similar flap not shown is foldably joined to the corresponding end of panel 49. A pair of hand gripping apertures 66 and 67 are formed in panel 49 and the strip of material therebetween is of double thickness due to the glue lap 49A which forms a part of wall 49. For a more complete description of the carton 47 and of its closure means, reference may be had to U.S. patent application Ser. No. 560,956 filed Mar. 21, 1975.

Collapsed cartons C in hopper 30 are arranged with their panels 45 and 49 in the same plane and constituting the lower panels of the stacked cartons. Stated otherwise, folding the panels 47 and 49 in a clockwise direction about fold lines 46 and 48 as viewed in FIG. 3 orients the carton in the proper disposition for insertion into the hopper 30. When so inserted the fold line 46 is in engagement with the back wall 30A of hopper 30 and the fold line 52 is adjacent the front wall 30B of hopper 30.

The dimension of panel 45 between fold lines 46 and 48 is substantial as is the dimension of panel 49 between fold lines 48 and 52. Thus when the cartons are stacked in hopper 30, there is a tendency for the cartons to bow downwardly particularly since panels 45 and 49 are interconnected by the fold line 48. Furthermore glue from the glue lap 49A sometimes becomes adhered to the face contacting inner surface of panel 50 when a carton is collapsed and secures panels 49 and 50 together. For these reasons it sometimes is difficult to cause a carton which is collapsed to occupy a properly set-up condition as depicted at C2 in FIG. 2.

In view of the above characteristics of sleeve type cartons such as that shown in FIG. 3, special feeder means has been provided according to this invention. As is best shown in FIGS. 4–8 inclusive, a main feeder arm 70 is pivotally mounted about fixed pivot 32 and at its right hand end is provided with a plurality of suction cups 72 to which vacuum is applied in known manner and which are swung into engagement with panel 45 when main feeder arm 70 is swung in a counterclockwise direction about fixed pivot 32. Operating movement is imparted to main feeder arm 70 by an arm 73 which is integral with arm 70 and to which a driving link 74 is pivoted at 75. Link 74 is reciprocated from left to right by rotatable operating element 76 which is disposed about fixed shaft 77 and rotated by any suitable means. Driving link 74 is pivotally connected to driving element 76 at 78. Thus rotation of driving element 76 imparts oscillatable swinging movement to main feeder arm 70 about its center of oscillation 32 to cause the suction cups 72 to move into engagement with panel 45 of the lowermost carton C in the hopper 30. Downward movement of suction cups 72 withdraws the lowermost carton from the hopper and swings it into cooperative engagement with carton opening means in the form of a pair of fixed cams 33 having cam surfaces 33A which are disposed at an angle to the generally downward direction of movement of the suction cups 72. Since the suction cups 72 engage the panel 45, downward movement of the feeder arm 73 causes the edge 52 of the carton to ride along cam surface 33A and thus imparts swinging movement to panel 49 in a counterclockwise direction about fold line 48 and simultaneously swings panel 47 counterclockwise about fold line 46 so that a carton C is partially set up in part due to the cooperative action of the main feeder arm 70 and the cam surfaces 33A as generally represented in FIG. 5.

Since there is a tendency for the lower panels 45 and 49 to bow downwardly and since glue may cause an undesired adhesion between panel 49 and its face contacting panel 50 which in turn tends to bow the upper panels 47 and 50 downwardly, it is necessary to prevent downward bowing of panels 47 and 50 during the initial stages of a carton feeding operation and also to insure rupture of any glue adhesion that may be formed between the glue joint in panel 49 and the inner surface of panel 50.

In order to impart an upward force on panels 47 and 50 as the panel 45 is drawn downwardly, supplementary feeder arm 81 is provided and is pivotally mounted on main feeder arm 70 at pivot 82. This arm is provided with a pair of upwardly projecting fingers 83 which are disposed to enter hand gripping aperture 67 and to engage the lower surface of panel 50. With supplementary feeder arm 81 arranged with its protruding fingers 83 is secure contact with panel 50 as the clockwise swinging movement of main feeder arm 70 begins, initial setting up of the carton may proceed whereby panels 45 and 49 are swung downwardly somewhat while panel 50 is maintained in its normal position within the hopper 30.

In order to cause the supplementary feeder arm 81 to function as desired by maintaining an upward force on panel 50, this arm is interconnected by an operating link 84 the right hand end of which is pivotally connected at 85 with supplementary operating arm 81 and a compressional biasing spring 86 is disposed about operating link 84 and at its left hand end is in engagement with shoulder 87 formed integrally on operating link 84 and which at its right hand end is in engagement with a bracket 88 affixed to main feeder arm 70 and through which operating link 84 is slidable via an aperture formed in bracket 88 but which is not shown in the drawings. The left hand end of operating link 84 is pivoted at 89 to a swing link 90 which in turn is oscillatable about pivot 32 which is also the pivot for main operating feeder arm 70. The left hand surface of the upper end of swing link 90 is engageable with fixed stop 91.

Figure 4:
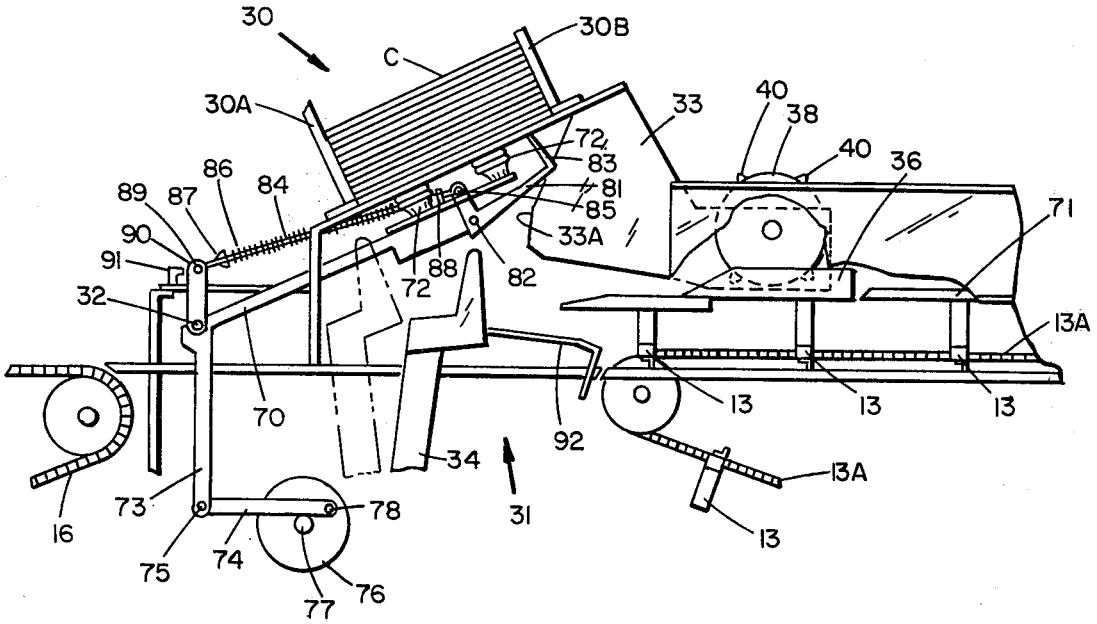
FIG. 4 is an enlarged side view of a portion of the structure shown in FIGS. 1 and 2 with certain parts removed for clarity and which shows the feeding mechanism at the beginning of a carton feeding operation.
Figure 5:
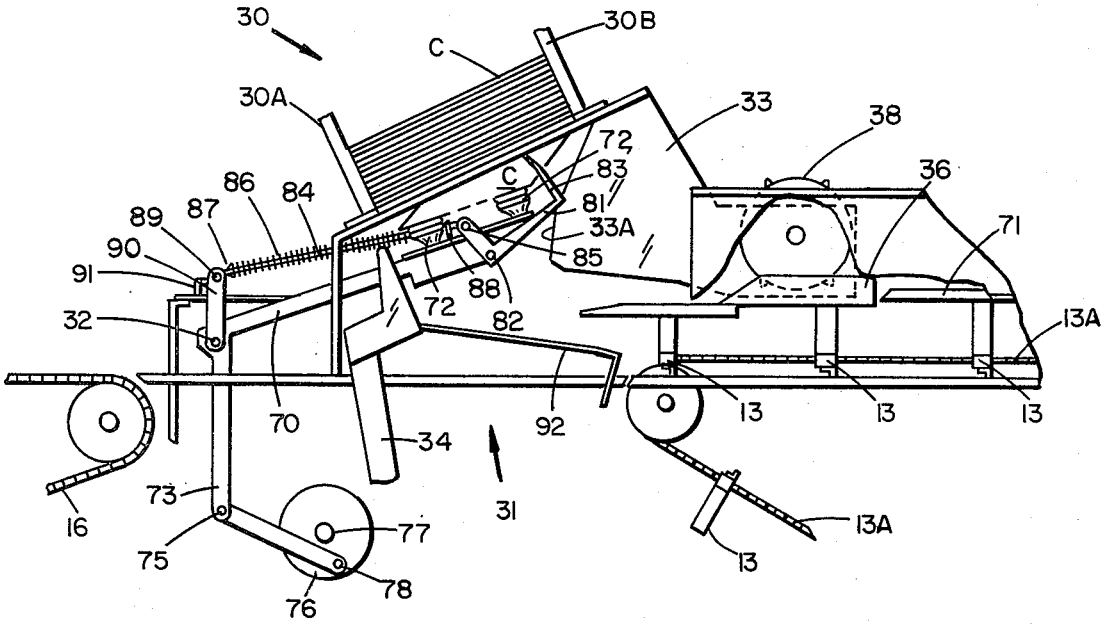
FIG. 5 is a view similar to FIG. 4 and depicts a feeding operation during a subsequent stage.

From the above description of the main feeder arm 70 and of the supplementary feeder arm 81 and associated apparatus, it is apparent that with the parts in the position shown in FIG. 4 clockwise swinging movement of main feeder arm 70 about its pivot 32 is accompanied by counterclockwise rotation of supplementary feeder arm 81 about its pivotal connection 82 with main feeder arm 70 due to the bias of compression spring 86 operating against shoulder 87 of operating link 84. Thus as main feeder arm 70 swings clockwise about its pivot 32, the supplementary feeder arm 81 swings through an angular increment about its pivot 82 in a counterclockwise direction so that as panel 45 of the lowermost carton is drawn downwardly, panel 50 is maintained in its normal position in the hopper due to the force exerted by fingers 83 which extend through hand gripping aperture 67 and into contact with the inner surface of panel 50. Thus as is shown in FIG. 5 the cooperative action of the main feeder arm 70 and supplementary feeder arm 81 insures a proper withdrawal of the carton from collapsed condition within hopper 30 into a partially set-up condition as shown in FIG. 5.

Figure 6:
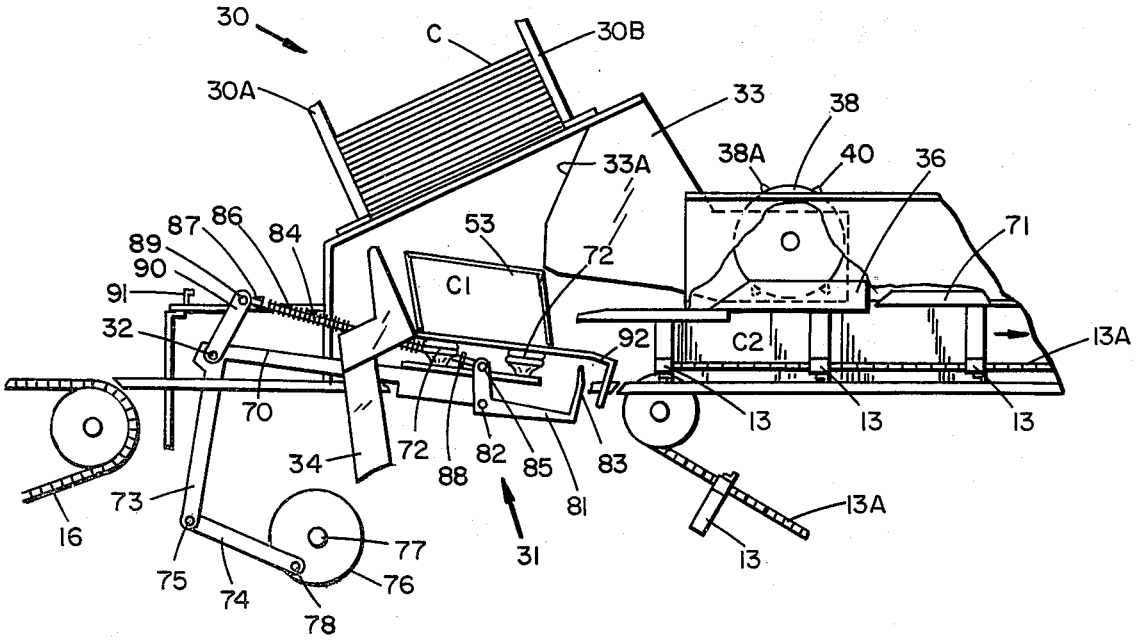
FIG. 6 is a view similar to FIGS. 4 and 5 and depicts the parts in the positions which they occupy immediately following stripping of a partially set-up carton from the feeder mechanism.
Figure 8:
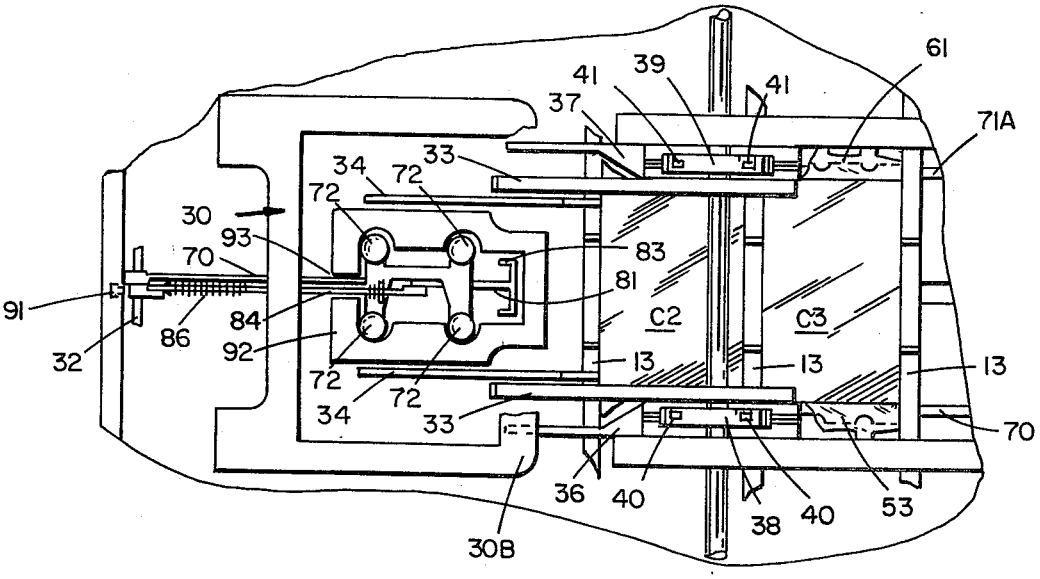
FIG. 8 is a plan view of structure such as is shown in FIG. 7.

Once a carton is withdrawn from the hopper and partially set up due to the action of the supplementary feeder arm and to the action of cam surfaces 33A, the carton then is moved to the lowermost position depicted in FIG. 6 where it is disposed atop the fixed carton stripper designated by the numeral 92 and occupies the position indicated at C1. In FIG. 8 it is apparent that carton stripper 92 is generally U-shaped with an aperture disposed medially thereof and having a space 93 through which the operating arm 70 and associated operating link 84 may move to occupy positions below the stripper 92 as shown in FIG. 6. Of course this action causes a carton such as C1 to become detached from the suction cups 72 and positions the carton for subsequent and immediate synchronized engagement with oscillatable pusher bar 34. This bar swings through an increment of oscillation in a clockwise direction about its pivot 35 and is so operated by any suitable known operating means omitted from the drawings for clarity. The operation of pusher bar 34 causes a carton located as indicated at C1 to move into engagement with the trailing surface of a transversely disposed flight bar 13 and maintains the carton in such position until a subsequent flight bar 13 moves in behind the trailing panel of the carton when it is moved to a position such as that designated at C2. When so disposed, the carton C2 is in effect fixed in position between a pair of spaced flight bars 13 and thus is incapable of escaping therefrom so that its position is fully and absolutely controlled. During this phase of the operation, end closure panels 53 and 61 ride atop guide bars 36 and 37 and pass underneath the prebrake rotatable elements 38 and 39 respectively which swing the locking tabs 57 out of the plane of panel 53 and condition these tabs for subsequent insertion into the apertures 58 and swing the locking tabs 64 out of the plane of their associated panel 61 and condition the locking tabs for subsequent insertion into the apertures (not shown) which are formed in panel 63. This prebraking action is facilitated by radially extending probes 40 and 41. Closure panels 53 and 61 are held in an upper position after the prebraking operation by fixed guides 71 and 71A prior to the closing and locking operations.

Of course sidewise motion of a carton such as C2 is prevented by engagement of the closure panels and associated end structure with the plows 36 and 37 which cooperate with the prebrake rotatable elements 38 and 39.

Figure 7:
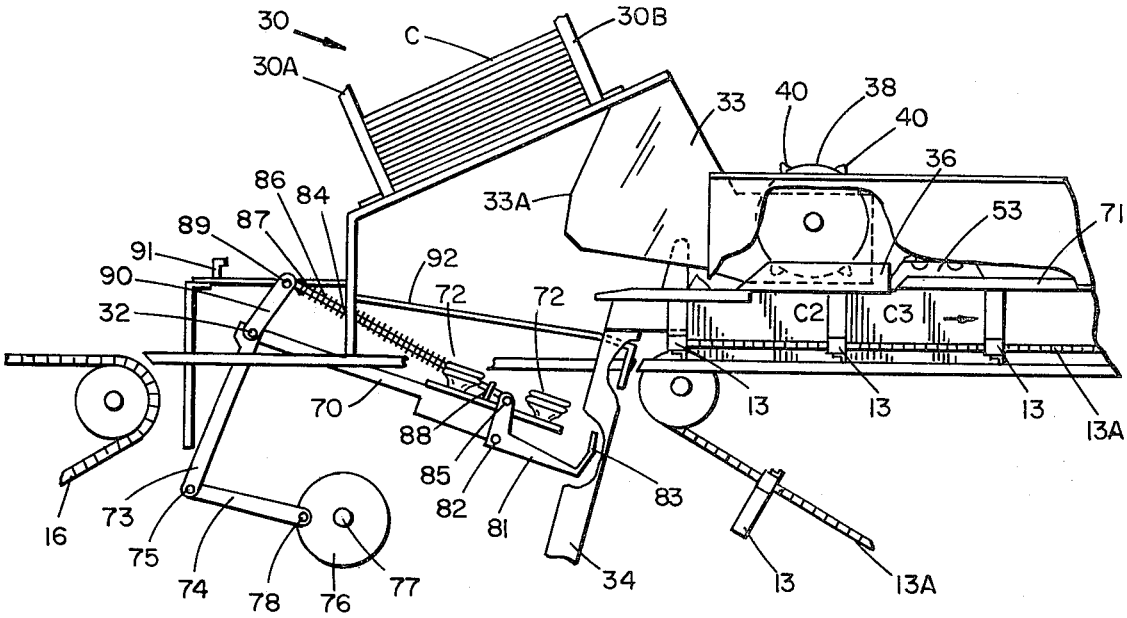

A carton such as that disposed at position C2 as represented in FIG. 7 is interposed between its leading and trailing flight bars 13 and moves toward the right through and into cooperative engagement with suitable plows such as are designated in FIG. 2 by the numeral 94 which manipulate the end closure panels such as 53, 54 into closed position and in like fashion plows 95 manipulate panels 61 and 63 into closed position. The flaps 59, 60 and 65 and the associated flap which is opposite flap 65 and adjoined to wall 49 are closed immediately prior to closing of the closure panels 53, 54, 61 and 63 by suitable means (not shown) but which is conventional in construction and in operation. Once the end closure panels are folded to their closed positions, they are interlocked by rotatable locking means 14 and 28 which include locking fingers 15 and 29 which fingers engage the locks such as 57 and 64 and force those locks into the apertures 58 and similar apertures in panel 63 to complete the packaging operation as described in more detail in the above mentioned U.S. patent application Ser. No. 560,956 filed Mar. 21, 1975.

From the above description, it is apparent that by the special main feeder arm and supplementary feeder arm constructed according to this invention, the inherent tendency of an open ended, glued sleeve type carton to bow downwardly in the hopper and perhaps to have undesired adhesions of panels due to the glue lap, are overcome by pressure applied to the carton by the supplementary feeder arm 81 and associated parts. Furthermore it is apparent that complete control of the blank is maintained by the unique cooperation of the feeder means, the pusher, and flight bars and that effective continuation of the opening operation initiated by the main feeder arm and the fixed cam structure immediately preceding stripping of the carton by the stripper insures an efficient loading operation with a minimum of difficulty and at maximum speed due in part to the precisely controlled cooperation of the parts so as to increase the output of the machine or conversely to reduce the rate at which the parts wear.

The embodiments of the invention in which an exclusive property or privilege is claimed are defined as follows:

1. A machine for sequentially manipulating collapsed pre-glued apertured sleeve type cartons out of a hopper and into set-up open ended condition for loading through the open ends thereof, said machine comprising a main feeder arm for sequentially withdrawing the cartons from the hopper, and a supplementary feeder arm arranged to project through an aperture in a lower carton wall to engage an upper carton wall thereby to disrupt any adhesive bond between said upper and said lower carton walls so as to facilitate setting up of the collapsed cartons into open ended condition.

2. A machine according to claim 1 wherein the cartons include a glued joint formed in said lower wall adjacent said aperture.

3. A machine according to claim 1 wherein said aperture constitutes a finger receiving carrying aperture.

4. A machine for sequentially manipulating collapsed sleeve type cartons out of a hopper and into set-up open ended condition for loading through the open ends thereof, said machine comprising an oscillatable main feeder arm for sequentially withdrawing the cartons from the hopper, and a supplementary feeder arm pivotally mounted on said main feeder arm and biased toward the hopper and engageable with a carton panel during the initial stages of a carton feeding operation for preventing undesired bowing thereof.

5. A machine for sequentially manipulating collapsed sleeve type cartons out of a hopper and into set-up open ended condition for loading through the open ends thereof, said machine comprising an oscillatable main feeder arm for sequentially withdrawing the cartons from the hopper, and a supplementary feeder arm pivotally mounted on the swing end of said main feeder arm for engaging the cartons during feeding operations for preventing undesired bowing thereof, and an oscillatable operating link having a radius of oscillation different from that of said main feeder arm for swinging said supplementary feeder arm about its pivotal mounting.

6. A machine according to claim 5 wherein the center of oscillation of said operating link is movable through an arcuate path about the center of oscillation of said main feeder arm.

7. A machine according to claim 6 wherein the arcuate path of movement of the center of oscillation of said operating link is determined by a swing link swingable about a center which is coaxially disposed relative to the center of oscillation of said main feeder arm and which pivotally connected with said operating link.

8. A machine according to claim 7 wherein the swinging movement of said swing link in one direction is determined by a fixed stop.

9. A machine according to claim 8 wherein biasing means is arranged to react between a part of said operating link and a part of said main feeder arm to impart swinging movement to said supplementary feeder arm in the general direction of the hopper during the initial stages of a feeding operation.

10. A machine according to claim 8 wherein swinging movement of said supplementary feeder arm in the general direction of said hopper is due in part to the force exerted thereon by biasing means reacting between a part of said main feeder arm and a part of said operating link.

* * * * *